US008519932B2

(12) United States Patent
Lee et al.

(10) Patent No.: US 8,519,932 B2
(45) Date of Patent: Aug. 27, 2013

(54) LIQUID CRYSTAL DISPLAY

(75) Inventors: Sunggae Lee, Gunpo-si (KR); Buyeol Lee, Goyang-si (KR); Jongjin Lim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 383 days.

(21) Appl. No.: 12/777,928

(22) Filed: May 11, 2010

(65) Prior Publication Data

US 2011/0134092 A1 Jun. 9, 2011

(30) Foreign Application Priority Data

Dec. 7, 2009 (KR) ..... 10-2009-0120731

(51) Int. Cl.
*G09G 3/36* (2006.01)
*G09G 5/00* (2006.01)

(52) U.S. Cl.
USPC ..... 345/98; 345/102; 345/204

(58) Field of Classification Search
USPC ..... 345/3.2, 94, 96, 99, 100, 102, 204, 345/209, 98, 208; 348/448
See application file for complete search history.

(56) References Cited

U.S. PATENT DOCUMENTS

| | | | | |
|---|---|---|---|---|
| 6,636,206 | B1 * | 10/2003 | Yatabe | 345/204 |
| 7,253,810 | B2 * | 8/2007 | Ito et al. | 345/204 |
| 2006/0022929 | A1 * | 2/2006 | Hashimoto et al. | 345/96 |
| 2007/0030236 | A1 * | 2/2007 | Kim et al. | 345/98 |
| 2009/0243995 | A1 * | 10/2009 | Kimura | 345/102 |

* cited by examiner

*Primary Examiner* — Quan-Zhen Wang
*Assistant Examiner* — Michael J Eurice
(74) *Attorney, Agent, or Firm* — Brinks Hofer Gilson & Lione

(57) ABSTRACT

The present invention relates to a liquid crystal display, wherein the liquid crystal display includes a POL conversion control signal generating unit for generating a POL conversion control signal that is inverted at predetermined time intervals in a black data insertion mode and is fixed at a specific logic level in a normal drive mode, a timing controller for outputting a first polarity control signal that is inverted every a predetermined period, a POL conversion circuit that receives the POL conversion control signal and the first polarity control signal to output a second polarity control signal, a data driving circuit that supplies a data voltage to data lines and inverts a polarity of the data voltage in response to the second polarity control signal, and a gate driving circuit that sequentially supplies a gate pulse to gate lines.

3 Claims, 16 Drawing Sheets

| INPUT | | OUTPUT |
|---|---|---|
| POLcon | POL1 | POL2 |
| 0 | 0 | 0 |
| 0 | 1 | 1 |
| 1 | 0 | 1 |
| 1 | 1 | 0 |

| INPUT | | OUTPUT |
|---|---|---|
| POLcon | POL1 | POL2 |
| 0 | 0 | 1 |
| 0 | 1 | 0 |
| 1 | 0 | 0 |
| 1 | 1 | 1 |

FIG. 18A

| R | G | B | R | G | B |
|---|---|---|---|---|---|
| + | − | + | − | + | − |
| − | + | − | + | − | + |
| + | − | + | − | + | − |
| − | + | − | + | − | + |

Nth frame

| R | G | B | R | G | B |
|---|---|---|---|---|---|
| − | + | − | + | − | + |
| + | − | + | − | + | − |
| − | + | − | + | − | + |
| + | − | + | − | + | − |

(N+1) th frame

| R | G | B | R | G | B |
|---|---|---|---|---|---|
| + | − | + | − | + | − |
| − | + | − | + | − | + |
| + | − | + | − | + | − |
| − | + | − | + | − | + |

(N+2) th frame

| R | G | B | R | G | B |
|---|---|---|---|---|---|
| − | + | − | + | − | + |
| + | − | + | − | + | − |
| − | + | − | + | − | + |
| + | − | + | − | + | − |

(N+3) th frame

LIQUID CRYSTAL DISPLAY

This application claims the benefit of Korea Patent Application No. 10-2009-0120731 filed on Dec. 7, 2009, which is incorporated herein by reference for all purposes as if fully set forth herein.

BACKGROUND

1. Field of the Invention

Embodiments of the disclosure relate to a liquid crystal display capable of operating in an impulse drive manner.

2. Discussion of the Related Art

Active matrix type liquid crystal displays display a motion picture using a thin film transistor (TFT) as a switching element. The active matrix type liquid crystal displays have been implemented in televisions as well as display devices in portable devices such as office equipments and computers, because of the thin profile of the active matrix type liquid crystal displays. Accordingly, cathode ray tubes (CRT) are being rapidly replaced by active matrix type liquid crystal displays.

A motion blur phenomenon occurs in which a motion picture displayed on the screen of a liquid crystal display is not clear and blurry because of hold characteristics of a liquid crystal material. When comparing the liquid crystal display with a cathode ray tube (CRT), as shown in FIG. 1, the CRT provides data to cells by causing a phosphor to emit light for a very short period of time to display an image in an impulse drive manner. On the other hand, as shown in FIG. 2, the liquid crystal display supplies data to liquid crystal cells during a scan period and then holds data charged to the liquid crystal cells during a remaining field period (or a frame period) to thereby display an image in a hold drive manner.

Because the CRT displays the motion picture in the impulse drive manner, a perceived image that a viewer perceives becomes clearer as shown in FIG. 3. On the other hand, as shown in FIG. 4, light and darkness of a perceived image that a viewer perceives are not clear and blurry because of the hold characteristics of the liquid crystal material in the motion picture displayed on the liquid crystal display. A difference between the perceived images of the CRT and the liquid crystal display is caused by an integral effect of an image temporarily held in eyes following a movement. Accordingly, even if the liquid crystal display has a fast response time, the viewer watches a blurry image because there is a difference between the movement of the eyes and a static image of each frame.

A method for driving the liquid crystal display in an impulse drive manner, for example, a black data insertion (BDI) method has been proposed so as to improve the motion blur phenomenon in the liquid crystal display. In the black data insertion method, the liquid crystal display provides video data on the screen of the liquid crystal display and then supplies black data to the screen, and thus can be driven the an impulse drive manner.

The black data insertion method is a method capable of obtaining an imaginary impulse drive effect by inserting black data between video data to be displayed. Because the black data is inserted between the video data to be displayed in the black data insertion method, a luminance reduction and a flicker of an image displayed on the liquid crystal display occur. If the liquid crystal display is driven at a frame frequency of 120 Hz, the problem of flicker in the black data insertion method has been improved. Further, the luminance reduction does not greatly affect most of liquid crystal displays except some of liquid crystal displays requiring a high luminance. FIG. 5 illustrates an example of driving a liquid crystal display at a frame frequency of 120 Hz without black data insertion. FIG. 6 illustrates an example of driving a liquid crystal display at a frame frequency of 120 Hz in a black data insertion manner.

The liquid crystal display inverts a polarity of a data voltage to be charged to liquid crystal cells every one frame period, so as to reduce direct current (DC) image sticking and to prevent degradation of liquid crystals. In a normal drive method in which the black data is not inserted, a polarity of a charge voltage (i.e., the data voltage) of the liquid crystal cells is inverted every one frame period as shown in FIG. 7, and thus a positive polarity data voltage and a negative polarity data voltage are cancelled each other out. Hence, a polarity deflection does not occur. On the other hand, in the black data insertion method, when the polarity of the data voltage of the liquid crystal cells is inverted every one frame period as shown in FIG. 8, the black data is repeatedly inserted as a voltage having the same polarity. Accordingly, as shown in FIG. 9, the black data insertion method generates a residual voltage in the liquid crystal cells because of the polarity deflection of the black data voltage, and as a result, the image sticking occurs.

BRIEF SUMMARY

A liquid crystal display comprises a liquid crystal display panel on which a plurality of data lines and a plurality of gate lines cross each other, a POL conversion control signal generating unit for generating a POL conversion control signal that is inverted at predetermined time intervals in a black data insertion mode and is fixed at a specific logic level in a normal drive mode, a timing controller for outputting a first polarity control signal that is inverted every a predetermined period, a POL conversion circuit for receiving the POL conversion control signal and the first polarity control signal and outputting a second polarity control signal, a data driving circuit for supplying a data voltage to the plurality of data lines and inverting a polarity of the data voltage in response to the second polarity control signal, and a gate driving circuit for sequentially supplying a gate pulse to the plurality of gate lines, wherein a logic inversion cycle of the second polarity control signal in the black data insertion mode is longer than a logic inversion cycle of the second polarity control signal in the normal drive mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIGS. 18A and 18B illustrate a polarity of dot inversion data in a black data insertion mode and a normal drive mode.

DETAILED DESCRIPTION OF THE DRAWINGS AND THE PRESENTLY PREFERRED EMBODIMENTS

A liquid crystal display according to exemplary embodiments of the disclosure controls a polarity of a data voltage output from a data driving circuit using a polarity control signal. The polarity control signal is inverted every one horizontal period or every two horizontal periods in dot inversion and also is inverted every one frame period. Thus, a polarity of a data voltage to be charged to a liquid crystal cell is inverted every one frame period. The liquid crystal display according to the exemplary embodiment of the invention converts a logic inversion cycle of a polarity control signal output from an existing timing controller into two frame periods using a POL conversion circuit, which is described later.

Figure 1:
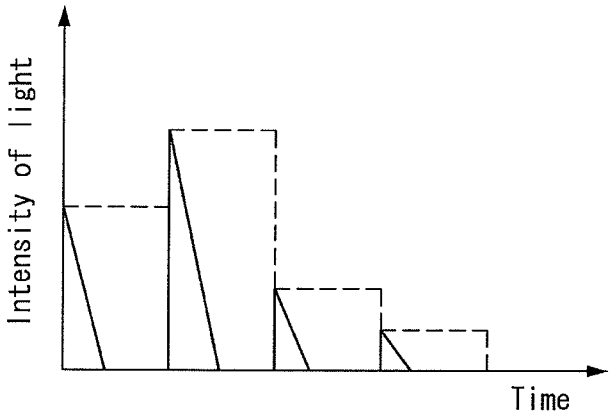
FIG. 1 (RELATED ART)
FIG. 1 illustrates emission characteristics of a cathode ray tube.
Figure 2:
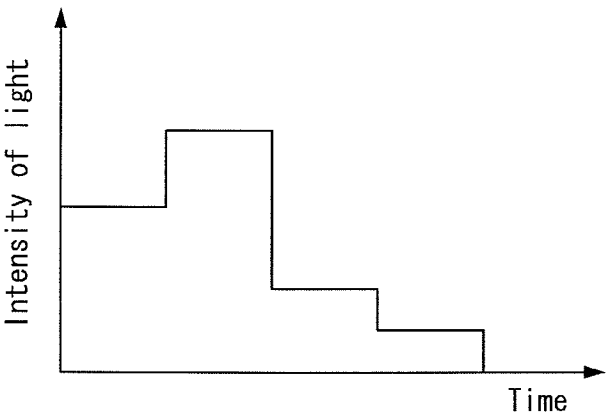
FIG. 2 (RELATED ART)
FIG. 2 illustrates emission characteristics of a liquid crystal display.
Figure 3:
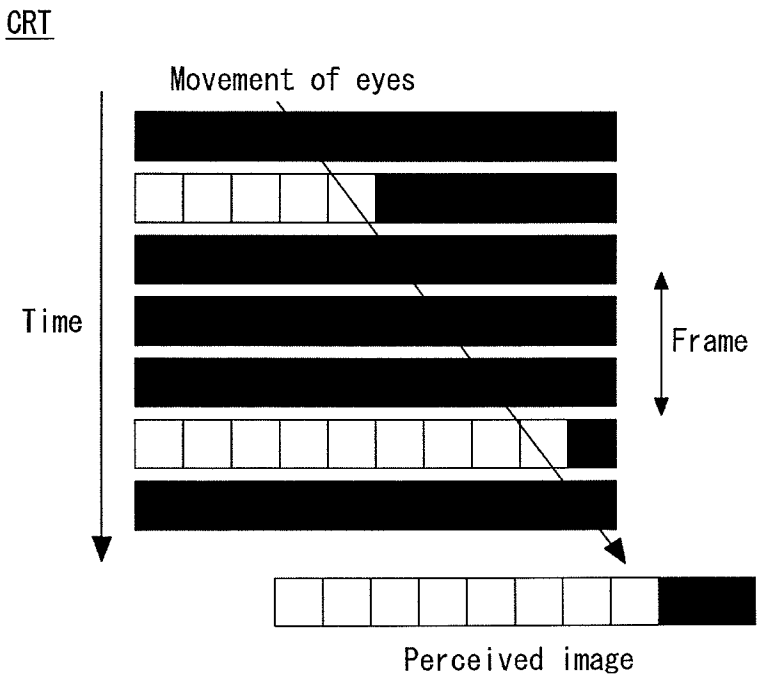
FIG. 3 (RELATED ART)
FIG. 3 illustrates a perceived image displayed on a cathode ray tube a viewer perceives.
Figure 4:
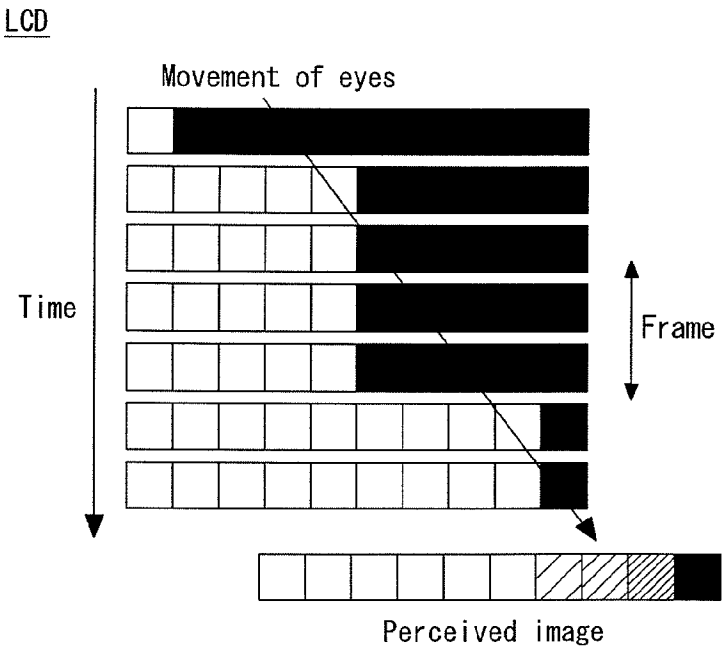
FIG. 4 (RELATED ART)
FIG. 4 illustrates a perceived image displayed on a liquid crystal display a viewer perceives.
Figure 5:
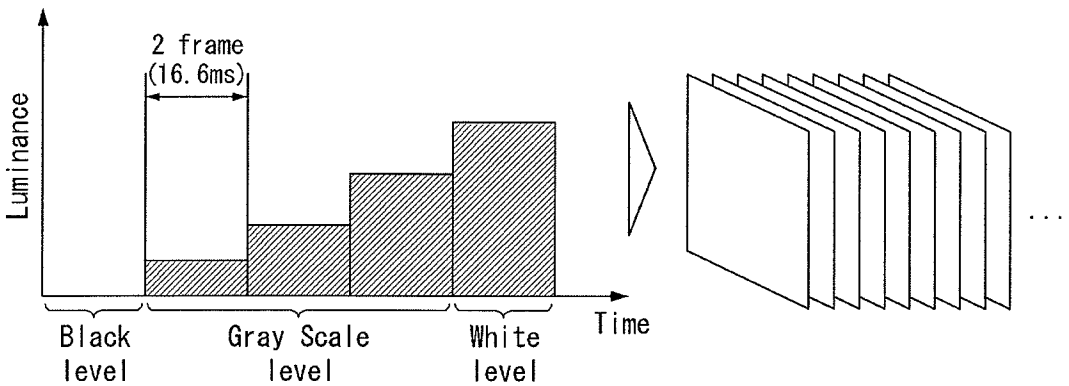
FIG. 5 (RELATED ART)
FIG. 5 illustrates an example of driving a liquid crystal display at a frame frequency of 120 Hz without black data insertion.
Figure 6:
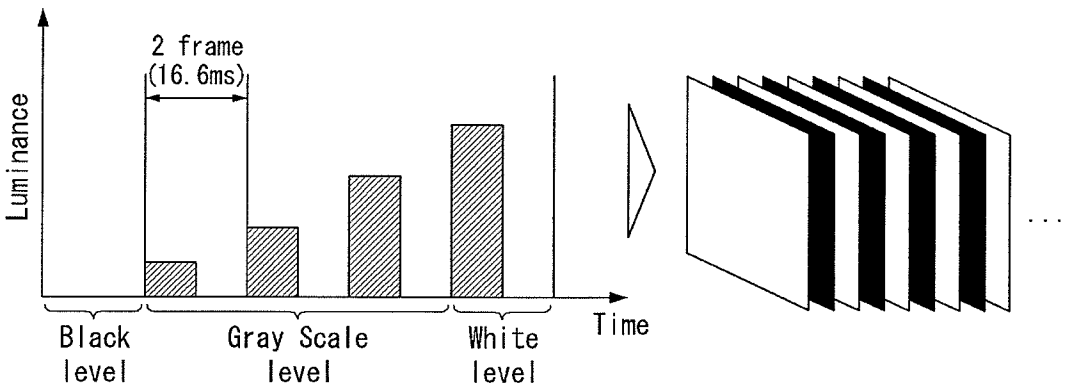
FIG. 6 (RELATED ART)
FIG. 6 illustrates an example of driving a liquid crystal display at a frame frequency of 120 Hz in a black data insertion manner.
Figure 7:
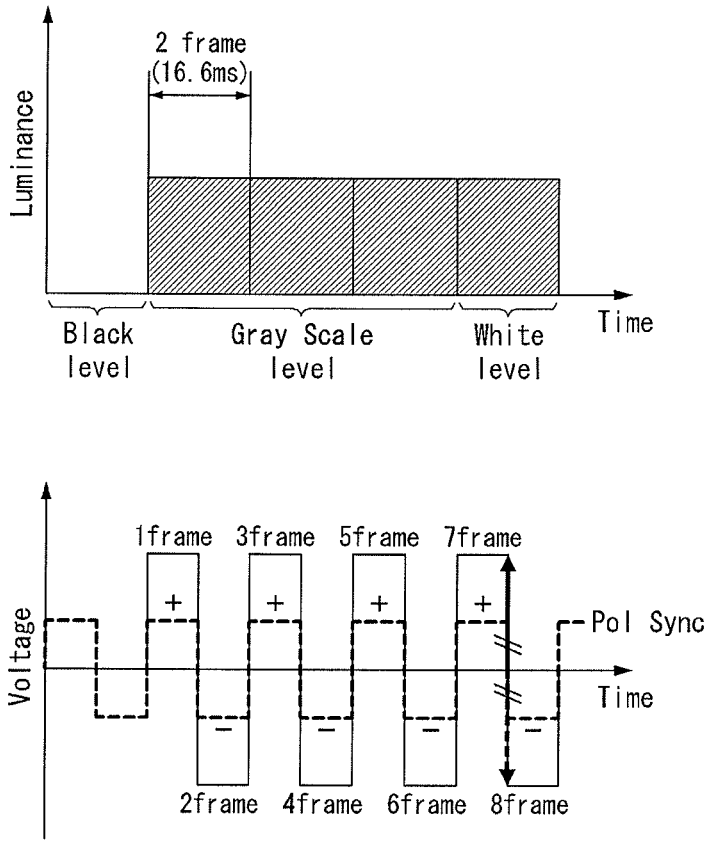
FIG. 7 (RELATED ART)
FIG. 7 is a graph illustrating a polarity cancellation of data in a normal drive mode where black data is not inserted.
Figure 8:
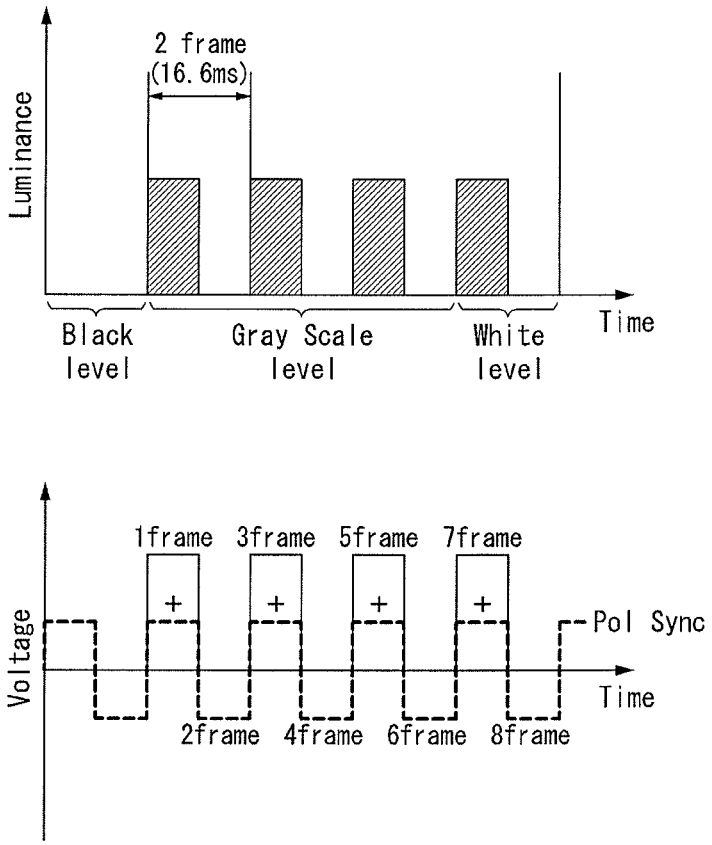
FIG. 8 (RELATED ART)
FIG. 8 is a graph illustrating a polarity deflection of data in a black data insertion manner.
Figure 9:
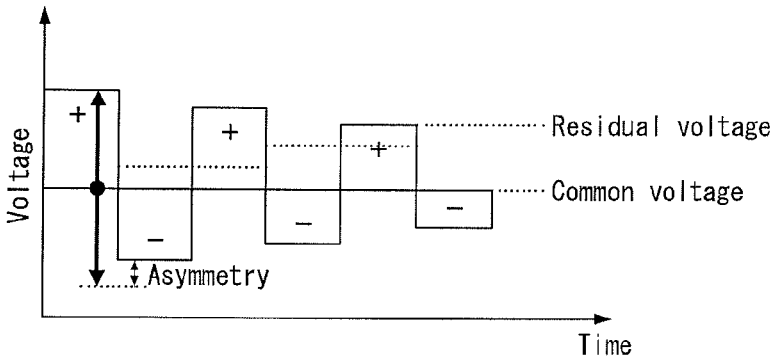
FIG. 9 (RELATED ART)
FIG. 9 is a graph illustrating a residual voltage accumulated because of a polarity deflection of a black data voltage.
Figure 10:
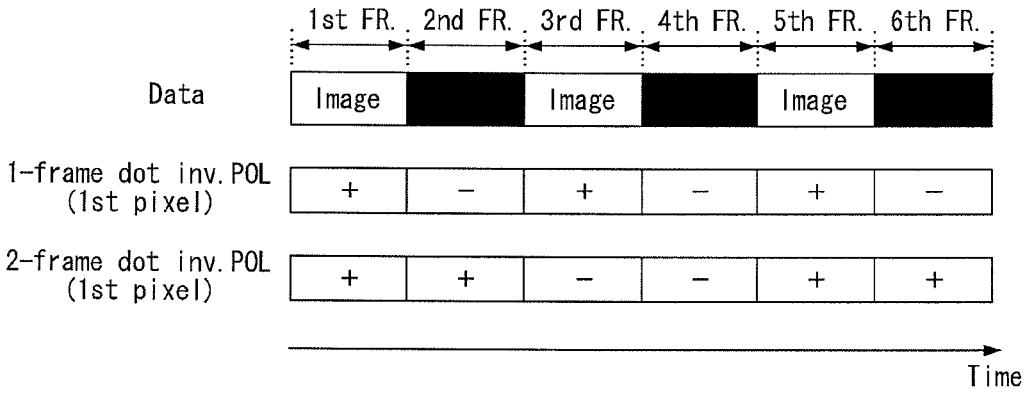
FIG. 10 illustrates polarities of a video data voltage and a black data voltage charged to a liquid crystal cell in 1-dot frame inversion and 2-frame dot inversion.

As shown in FIG. 10, each of liquid crystal cells of the liquid crystal display according to the exemplary embodiment of the invention charges a video data voltage of a first polarity during Nth frame period, where N is a positive integer, and then charges a black data voltage of the first polarity during (N+1)th frame period so as to obtain an impulse effect. Subsequently, each liquid crystal cell charges the video data voltage of a second polarity during (N+2)th frame period and then charges the black data voltage of the second polarity during (N+3) frame period. Thus, a polarity of each of the video data voltages and a polarity of each of the black data voltages in the liquid crystal cells are inverted every two frame periods. As a result, because each of the liquid crystal cells is alternately charged to the black data voltage of a positive polarity and the black data voltage of a negative polarity, a residual voltage is not accumulated in the liquid crystal cells.

The invention will be described more fully hereinafter with reference to the accompanying drawings, in which example embodiments of the inventions are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

Names of elements used in the following description are selected in consideration of facility of specification preparation. Thus, the names of the elements may be different from names of elements used in a real product.

Figure 11:
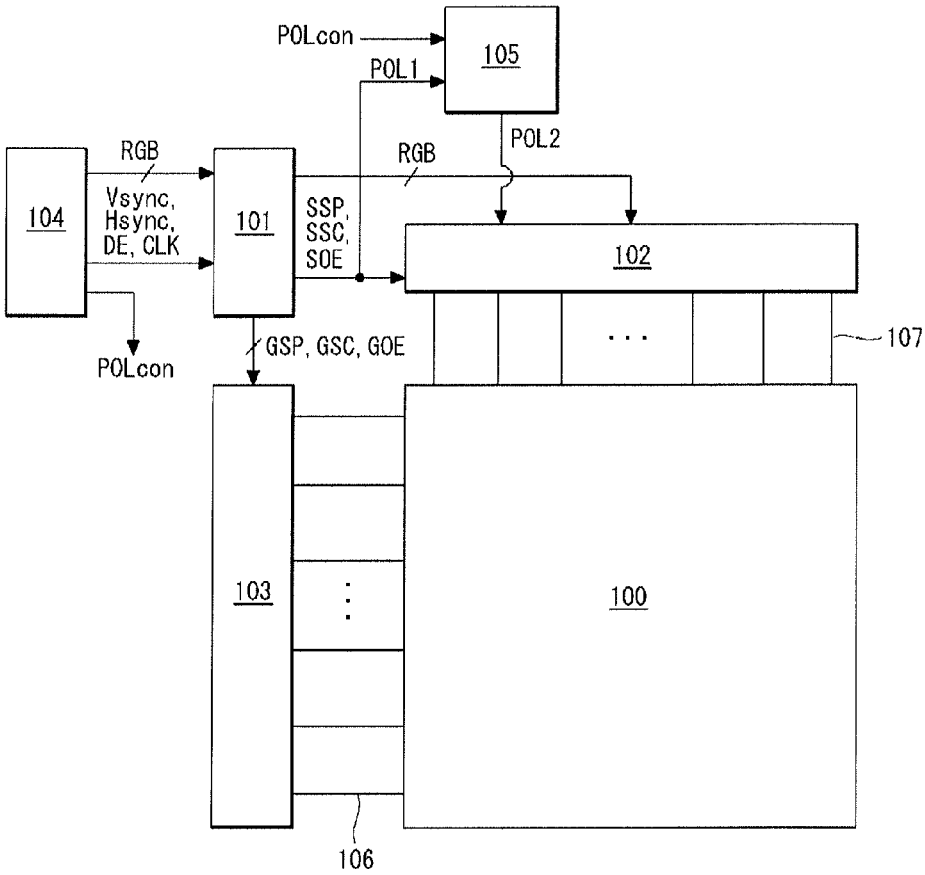
FIG. 11 is a block diagram of a liquid crystal display according to an exemplary embodiment of the invention.

As shown in FIG. 11, the liquid crystal display according to the exemplary embodiment of the invention includes a liquid crystal display panel 100, a timing controller 101, a POL conversion circuit 105, a data driving circuit 102, a gate driving circuit 103, and a system board 104.

The liquid crystal display panel 100 includes an upper glass substrate, a lower glass substrate, and a liquid crystal layer between the upper and lower glass substrates. The liquid crystal display panel 100 includes liquid crystal cells arranged in a matrix form according to a cross structure of data lines 107 and gate lines 106.

The data lines 107, the gate lines 106, thin film transistors (TFTs), a storage capacitor, etc. are formed on the lower glass substrate of the liquid crystal display panel 100. The liquid crystal cells are connected to the TFTs and are driven by an electric field between pixel electrodes and a common electrode. A black matrix, a color filter, the common electrode 2, etc, are formed on the upper glass substrate of the liquid crystal display panel 100. Polarizing plates are respectively attached to the upper and lower glass substrates of the liquid crystal display panel 100. Alignment layers for setting a pretilt angle of liquid crystals are respectively formed on the upper and lower glass substrates. In a vertical electric drive manner such as a twisted nematic (TN) mode and a vertical alignment (VA) mode, the common electrode is formed on the upper glass substrate. In a horizontal electric drive manner such as an in-plane switching (IPS) mode and a fringe field switching (FFS) mode, the common electrode is formed on the lower glass substrate along with the pixel electrode.

The liquid crystal display panel 100 applicable to the embodiment of the invention may be implemented in any liquid crystal mode as well as the TN, VA, IPS, and FFS modes. The liquid crystal display according to the exemplary embodiment of the invention may be implemented as any type liquid crystal display including a backlit liquid crystal display, a transflective liquid crystal display, and a reflective liquid crystal display. A backlight unit and the transflective liquid crystal display are necessary in the backlit liquid crystal display. The backlight unit may be one of a direct type backlight unit and an edge type backlight unit.

The timing controller 101 receives digital video data RGB from the system board 104 through an interface receiving circuit, such as a low voltage differential signaling (LVDS) interface and a transition minimized differential signaling (TMDS) interface. The timing controller 101 inserts black data, which is read from a built-in resistor, between the digital video data RGB received from the system board 104 to rearrange data and then transfers the rearranged data to the data driving circuit 102. The timing controller 101 supplies the digital video data RGB to the data driving circuit 102 during Nth frame period(s), where N is a positive integer, and then supplies the black data to the data driving circuit 102 during (N+1)th frame periods. Subsequently, the timing controller 101 supplies the digital video data RGB to the data driving circuit 102 during (N+2)th frame periods and then supplies the black data to the data driving circuit 102 during (N+3) frame periods.

The timing controller 101 receives a timing signal, such as a vertical sync signal Vsync, a horizontal sync signal Hsync, a data enable signal DE, and a dot clock CLK, from the system board 104 through the interface receiving circuit, such as the LVDS interface and the TMDS interface, to generate control signals for controlling operation timings of the data driving circuit 102 and the gate driving circuit 103. The control signals include a gate timing control signal for controlling operation time of the gate driving circuit 103 and a data timing control signal for controlling operation time of the data driving circuit 102 and a polarity of a data voltage.

The gate timing control signal includes a gate start pulse GSP, a gate shift clock GSC, a gate output enable signal GOE, and the like. The gate start pulse GSP is applied to a gate driver integrated circuit (IC) generating a first gate pulse and controls the gate driver IC so that the first gate pulse is generated in the gate driver IC. The gate shift clock GSC is a clock commonly input to a plurality of gate driver ICs of the gate driving circuit 103 and also is a clock for shifting the gate start pulse GSP. The gate output enable signal GOE controls outputs of the gate driver ICs.

The data timing control signal includes a source start pulse SSP, a source sampling clock SSC, a first polarity control signal POL1, a source output enable signal SOE, and the like. The source start pulse SSP controls data sampling start time of the data driving circuit 102. The source sampling clock SSC controls sampling timing of data inside the data driving circuit 102 based on a rising or falling edge. The first polarity control signal POL1 controls a polarity of the data voltage output from the data driving circuit 102. A logic level of the first polarity control signal POL1 is inverted every N horizontal period(s) in N-dot inversion and also is inverted every one frame period. The source output enable signal SOE controls output timing of the data driving circuit 102. If the digital video data RGB to be input to the data driving circuit 102 is transferred according to mini LVDS interface standard, the source start pulse SSP and the source sampling clock SSC may be omitted.

The system board 104 or the timing controller 101 may multiply a frame frequency to obtain a frame frequency of (60×i) Hz, where i is an integer equal to or greater than 2, thereby driving the liquid crystal display panel 100 at the frame frequency of (60×i) Hz.

The POL conversion circuit 105 converts the first polarity control signal POL1 received from the timing controller 101 into a second polarity control signal POL2 in response to a POL conversion control signal POLcon received from the system board 104. A logic level of the second polarity control signal POL2 is inverted every N horizontal period(s) in the N-dot inversion and also is inverted every two frame periods. Because in the liquid crystal display according to the exemplary embodiment of the invention, the POL conversion circuit 105 is used to convert the first polarity control signal POL1 output from the existing timing controller into the second polarity control signal POL2, the timing controller 101 applicable to the exemplary embodiment of the invention may use a timing controller generally used in most of liquid crystal displays. The POL conversion circuit 105 may be mounted inside the timing controller 101.

The data driving circuit 102 includes a plurality of source driver integrated circuits (ICs). Each of the source driver ICs includes a shift register, a latch, a digital-to-analog converter (DAC), an output buffer, and the like. Each of the source driver ICs latches the digital video data RGB and the black data under the control of the timing controller 101. The data driving circuit 102 converts the latched digital video data RGB and the latched black data into positive and negative analog gamma compensation voltages to invert a polarity of the data voltage. Further, the data driving circuit 102 inverts polarities of the data voltages output to the data lines 107 in response to the second polarity control signal POL2. Each of the source driver ICs may be connected to the data lines 107 of the liquid crystal display panel 100 through a chip on glass (COG) process or a tape automated bonding (TAB) process.

The gate driving circuit 103 includes a plurality of gate driver ICs. The gate driving circuit 103 sequentially supplies a gate pulse to the gate lines 106 in response to the gate timing control signal. The gate driver ICs of the gate driving circuit 103 may be connected to the gate lines 106 of the lower glass substrate of the liquid crystal display panel 100 through the TAB process or may be directly formed on the lower glass substrate through a gate-in-panel (GIP) process.

The system board 104 transfers the digital video data RGB and the timing signals Vsync, Hsync, DE, and CLK to the timing controller 101 through an interface such as the LVDS interface and the TMDS interface. The system board 104 includes a signal generating unit generating the POL conversion control signal POLcon and transfers the POL conversion control signal POLcon to the POL conversion circuit 105 through an interface such as the LVDS interface and the TMDS interface. The system board 104 controls a logic inversion cycle of the second polarity control signal POL2 using the POL conversion circuit 105. More specifically, the system board 104 controls so that a logic inversion cycle of the second polarity control signal POL2 in the black data insertion mode is longer than a logic inversion cycle of the second polarity POL2 control signal in a normal drive mode.

Figures 12, 13:
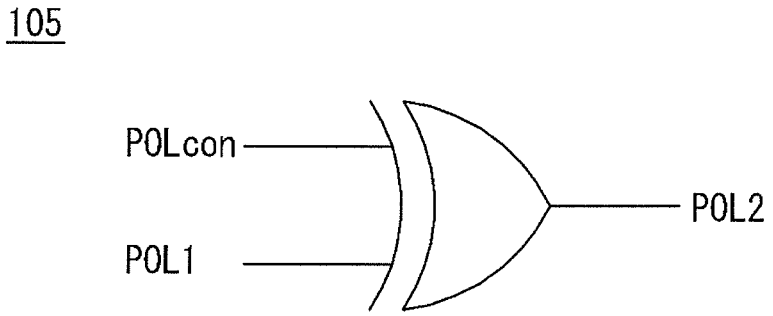
FIG. 12 is a circuit diagram illustrating a first embodiment of a POL conversion circuit.
FIG. 13 illustrates an input and an output of the POL conversion circuit shown in FIG. 12.

FIG. 12 illustrates a first embodiment of the POL conversion circuit 105.

As shown in FIG. 12, the POL conversion circuit 105 includes an exclusive OR (XOR) gate. The XOR gate receives the POL conversion control signal POLcon and the first polarity control signal POL1. The XOR gate performs an XOR operation on the POL conversion control signal POLcon and the first polarity control signal POL1. A result of the XOR operation is indicated in a truth table of FIG. 13.

Figure 14A:
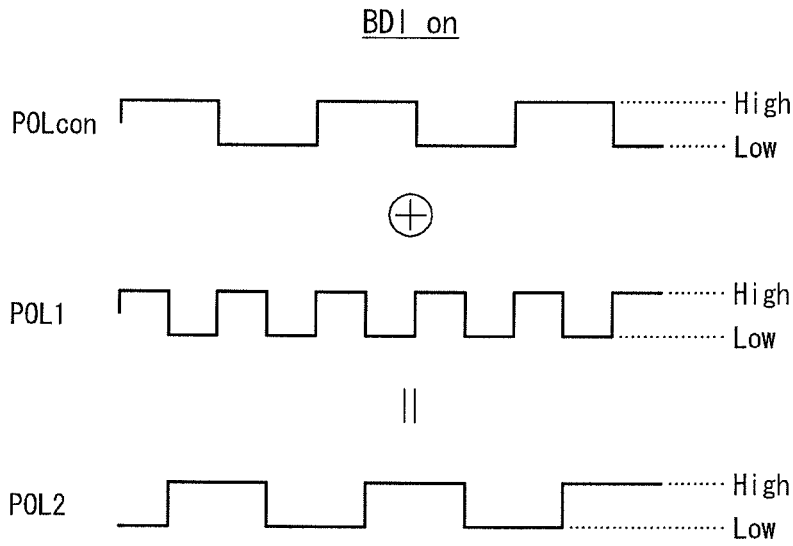
FIGS. 14A and 14B are waveform diagrams illustrating an example of an operation of the POL conversion circuit shown in FIG. 12 in a black data insertion mode and a normal drive mode.
Figure 14B:
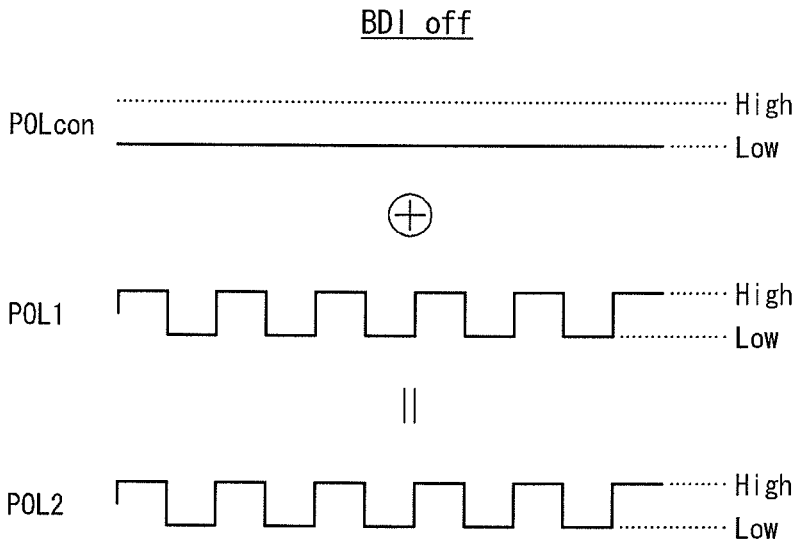

FIGS. 14A and 14B are waveform diagrams illustrating an example of an operation of the POL conversion circuit 105 shown in FIG. 12 in a black data insertion mode BDI_on and a normal drive mode BDI_off.

As shown in FIG. 14A, the system board 104 inverts a logic level of the POL conversion control signal POLcon every two frame periods in the black data insertion mode BDI_on. The XOR gate performs an XOR operation on the POL conversion control signal POLcon inverted every two frame periods and the first polarity control signal POL1 inverted every one frame period to output the second polarity control signal POL2 inverted every two frame periods.

As shown in FIG. 14B, the system board 104 fixes a logic level of the POL conversion control signal POLcon to a low logic level in the normal drive mode BDI_off in which the black data is not inserted. The XOR gate performs an XOR operation on the POL conversion control signal POLcon of the low logic level and the first polarity control signal POL1 inverted every one frame period to output the second polarity control signal POL2 that is in phase with the first polarity control signal POL1.

Figures 15, 16:
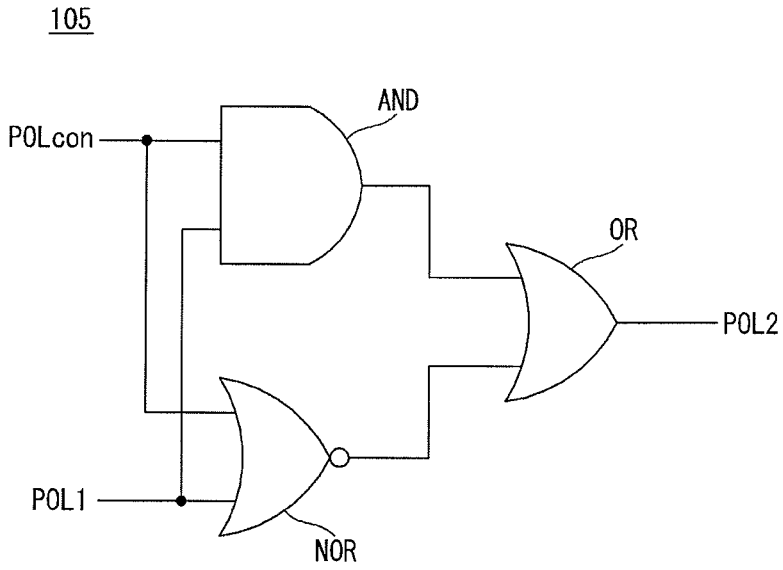
FIG. 15 is a circuit diagram illustrating a second embodiment of a POL conversion circuit.
FIG. 16 illustrates an input and an output of the POL conversion circuit shown in FIG. 15.

FIG. 15 illustrates a second embodiment of the POL conversion circuit 105.

As shown in FIG. 15, the POL conversion circuit 105 includes an AND gate, an NOR gate, and an OR gate. The AND gate performs an AND operation on the POL conversion control signal POLcon and the first polarity control signal POL1 to output a result of the AND operation, and the NOR gate performs an NOR operation on the POL conversion control signal POLcon and the first polarity control signal POL1 to output a result of the NOR operation. The OR gate performs an OR operation on an output of the AND gate and an output of the NOR gate to output a result of the OR operation. The input and output of the POL conversion circuit 105 shown in FIG. 15 are indicated in a truth table of FIG. 16.

Figure 17A:
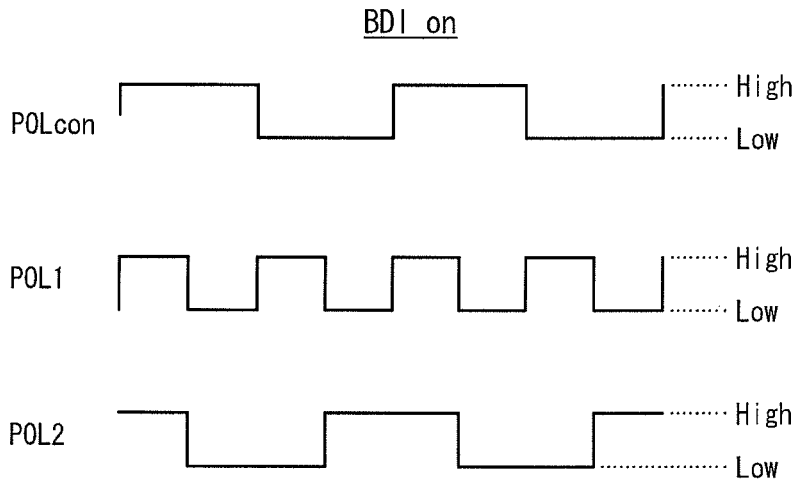
FIGS. 17A and 17B are waveform diagrams illustrating an example of an operation of the POL conversion circuit shown in FIG. 15 in a black data insertion mode and a normal drive mode.
Figure 17B:
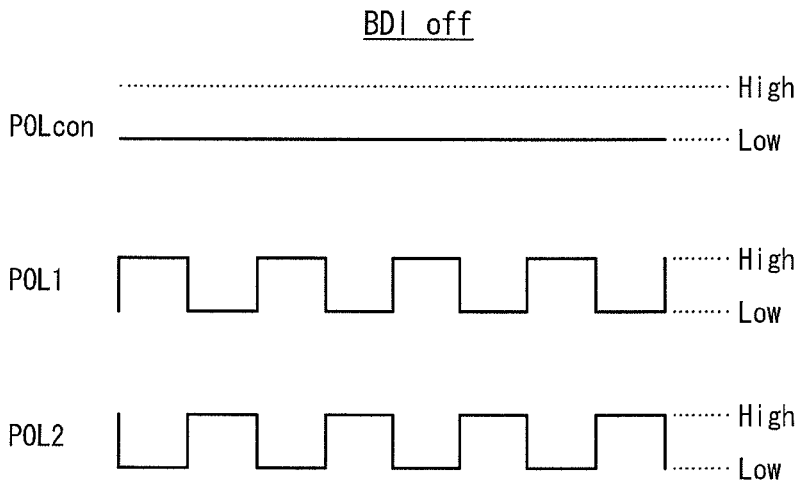

FIGS. 17A and 17B are waveform diagrams illustrating an example of an operation of the POL conversion circuit 105 shown in FIG. 15 in a black data insertion mode BDI_on and a normal drive mode BDI_off.

As shown in FIG. 17A, the system board 104 inverts a logic level of the POL conversion control signal POLcon every two frame periods in the black data insertion mode BDI_on. The POL conversion circuit 105 shown in FIG. 15 receives the POL conversion control signal POLcon inverted every two frame periods and the first polarity control signal POL1 inverted every one frame period to output the second polarity control signal POL2 inverted every two frame periods.

As shown in FIG. 17B, the system board 104 fixes a logic level of the POL conversion control signal POLcon to a low logic level in the normal drive mode BDI_off in which the black data is not inserted. The POL conversion circuit 105 shown in FIG. 15 receives the POL conversion control signal POLcon of the low logic level and the first polarity control signal POL1 inverted every one frame period to output the second polarity control signal POL2 that is out of phase with the first polarity control signal POL1.

Figure 18B:
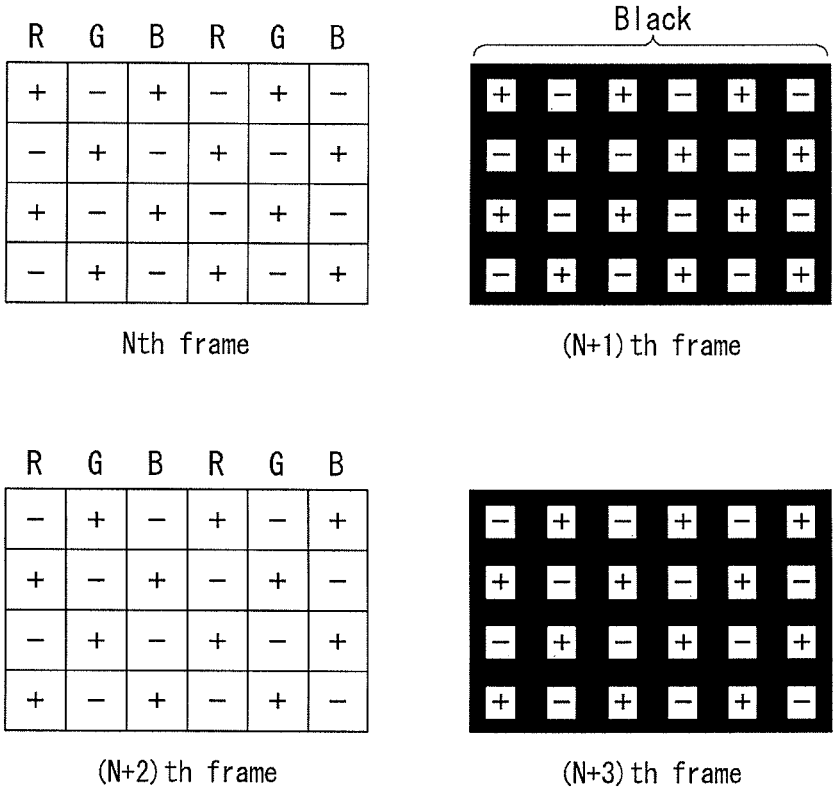

FIGS. 18A and 18B illustrate a polarity of dot inversion data in the black data insertion mode BDI_on and the normal drive mode BDI_off. The system board 104 may control the logic inversion cycle of the second polarity control signal POL2 input to the data driving circuit 102 using the POL conversion control signal POLcon. The liquid crystal display according to the exemplary embodiment of the invention prevents the polarity deflection of the black data voltage in the black data insertion mode BDI_on, thereby preventing the image sticking. Further, the liquid crystal display according to the exemplary embodiment of the invention inverts the polarity of the data voltage charged to the liquid crystal cells every one frame period in the normal drive mode BDI_off, thereby preventing the flicker.

As described above, the liquid crystal display according to the embodiment of the invention inserts the black data between the video data using the POL conversion control signal in the black data insertion mode, thereby reducing the motion blur. Furthermore, the liquid crystal display according to the embodiment of the invention may switch between the black data insertion mode and the normal drive mode using the POL conversion control signal. Furthermore, the liquid crystal display according to the embodiment of the invention controls the logic inversion cycle of the polarity control signal, thereby preventing the polarity deflection of the black data voltage supplied to the liquid crystal display panel.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A liquid crystal display comprising:

a liquid crystal display panel on which a plurality of data lines and a plurality of gate lines cross each other;

a POL conversion control signal generating unit for generating a POL conversion control signal that is inverted at predetermined time intervals in a black data insertion mode and is fixed at a specific logic level in a normal drive mode, wherein the black data insertion mode is a mode that inserts black data between video data, and the normal drive mode is a mode that does not insert the black data between the video data;

a timing controller for outputting a first polarity control signal (POL1) that is inverted every a predetermined period;

a POL conversion circuit for receiving the POL conversion control signal and the first polarity control signal (POL1) and outputting a second polarity control signal;

a data driving circuit for supplying a data voltage to the plurality of data lines by converting the video data into the data voltage and inverting a polarity of the data voltage in response to the second polarity control signal (POL2); and a gate driving circuit for sequentially supplying a gate pulse to the plurality of gate lines, wherein the first polarity control signal is inverted every one frame period, and the second polarity control signal is inverted every two frame periods in the black data insertion mode and is inverted every one frame period in the normal drive mode.

2. The liquid crystal display of claim 1, wherein the POL conversion circuit includes an exclusive OR (XOR) gate that performs an XOR operation on the POL conversion control signal and the first polarity control signal to output a result of the XOR operation.

3. The liquid crystal display of claim 1, wherein the POL conversion circuit includes:

an AND gate that performs an AND operation on the POL conversion control signal and the first polarity control signal to output a result of the AND operation;

an NOR gate that performs an NOR operation on the POL conversion control signal and the first polarity control signal to output a result of the NOR operation; and an OR gate performs an OR operation on an output of the AND gate and an output of the NOR gate to output a result of the OR operation.

* * * * *